US007497203B2

(12) United States Patent
Ibrahim et al.

(10) Patent No.: US 7,497,203 B2
(45) Date of Patent: Mar. 3, 2009

(54) AVOIDANCE OF SPARK DAMAGE ON VALVE MEMBERS

(75) Inventors: Daniel R. Ibrahim, Metamora, IL (US); Jeremy T. Claus, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 434 days.

(21) Appl. No.: 11/195,757

(22) Filed: Aug. 3, 2005

(65) Prior Publication Data

US 2007/0028869 A1 Feb. 8, 2007

(51) Int. Cl.
*F02M 47/02* (2006.01)
*F02M 63/00* (2006.01)

(52) U.S. Cl. ..... 123/472; 123/467; 123/458; 123/198 D; 251/129.16

(58) Field of Classification Search ..... 123/467, 123/458, 500, 501, 198 D, 472; 251/129.15, 251/129.16
See application file for complete search history.

(56) References Cited

U.S. PATENT DOCUMENTS

| | | | | |
|---|---|---|---|---|
| 3,698,684 | A | 10/1972 | Grenier | |
| 4,111,178 | A | 9/1978 | Casey | |
| 4,341,196 | A | 7/1982 | Canup et al. | |
| 4,508,174 | A | 4/1985 | Skinner et al. | |
| 4,566,482 | A | 1/1986 | Stunkard | |
| 4,877,187 | A | 10/1989 | Daly | |
| 4,893,781 | A | 1/1990 | Kalain et al. | |
| 4,909,447 | A * | 3/1990 | Gallup et al. | 239/585.3 |
| 5,238,224 | A * | 8/1993 | Horsting | 251/129.16 |
| 5,558,311 | A | 9/1996 | Connolly et al. | |
| 5,595,215 | A | 1/1997 | Wallace et al. | |
| 5,603,355 | A | 2/1997 | Miyazoe et al. | |
| 5,715,788 | A | 2/1998 | Tarr et al. | |
| 6,390,385 | B1 | 5/2002 | Hardy et al. | |
| 6,598,852 | B2 | 7/2003 | Tomoda et al. | |
| 6,712,035 | B2 | 3/2004 | Gottemoller et al. | |
| 6,793,196 | B2 * | 9/2004 | VanWeelden et al. | 251/129.07 |
| 6,851,622 | B2 * | 2/2005 | Demere et al. | 239/5 |
| 6,874,475 | B2 * | 4/2005 | Katsura et al. | 123/467 |
| 6,923,429 | B2 | 8/2005 | Merrill et al. | |
| 7,004,450 | B2 * | 2/2006 | Yoshimura et al. | 251/129.15 |

(Continued)

FOREIGN PATENT DOCUMENTS

DE 196 38 025 A1 3/1998

(Continued)

OTHER PUBLICATIONS

International Search Report re PCT/US2007/025527 dated May 15, 2008.

*Primary Examiner*—Stephen K Cronin
*Assistant Examiner*—Arnold Castro
(74) *Attorney, Agent, or Firm*—Finnegan, Henderson, Farabow, Garrett & Dunner

(57) ABSTRACT

An apparatus is provided for suppressing spark damage to components of a solenoid operated valve assembly. The assembly may include a solenoid having a solenoid coil and an armature movable under the influence of the solenoid coil. A valve member may be operably connected to the armature and configured to selectively contact a valve seat. An element may be associated with the solenoid operated valve assembly and configured to suppress spark discharge between two or more of the components of the valve assembly.

24 Claims, 4 Drawing Sheets

U.S. PATENT DOCUMENTS

| | | | | |
|---|---|---|---|---|
| 7,243,637 | B2 * | 7/2007 | Kaneko et al. | 123/467 |
| 2002/0145125 | A1 | 10/2002 | Tomoda et al. | |
| 2003/0062492 | A1 | 4/2003 | Haeberet et al. | |
| 2008/0156905 | A1 | 7/2008 | Shafer et al. | |

FOREIGN PATENT DOCUMENTS

| | | | |
|---|---|---|---|
| DE | 101 31 125 | | 9/2002 |
| EP | 0 661 446 | A1 | 7/1995 |
| EP | 1 150 001 | | 8/2005 |
| EP | 1 707 797 | | 8/2007 |
| WO | WO 2005/002292 | A1 | 1/2005 |

* cited by examiner

AVOIDANCE OF SPARK DAMAGE ON VALVE MEMBERS

TECHNICAL FIELD

The present disclosure relates to an apparatus and a method for avoidance of spark damage on valve members and, more particularly, to an apparatus and a method for avoiding spark damage to valve members in a solenoid operated valve assembly.

BACKGROUND

Engines sometimes use fuel injection systems to introduce fuel into the combustion chambers of the engine. The fuel injection system may be of various types and may include within the system a number of fuel injectors. A fuel injector may include, among the various valves controlling the flow of fuel, solenoid operated valve assemblies. A solenoid operated valve assembly may include a solenoid and an associated valve. The solenoid may include a solenoid coil which acts as a magnet when provided with current, an armature, and a biasing spring.

When the solenoid coil is provided with current, a toroidal field of magnetic flux develops rapidly. While ideally confined to the solenoid coil itself, in reality the magnetic flux tends to fringe into other components, such as, for example, the biasing spring. Relative movement between the electrically conductive biasing spring and the magnetic field may result in an induced voltage in the biasing spring. The induced voltage may result in current flow through valve members of the solenoid controlled valve assembly. Relative movement of cooperating valve members may then cause arcing, which may result in pitting of one or more of the valve members.

At least one system has been developed for mitigating pitting that can occur on a valve seat of a valve when current flows through valve members and the valve is opened. For example, U.S. Pat. No. 4,341,196 (the '196 patent) issued to Canup, et al. on Jul. 27, 1982, discloses a system for purposefully directing current through a fuel injection nozzle valve. Opening the valve breaks current flow to generate a control signal for initiating ignition in an engine. Particularly, the system of the '196 patent provides an electrical circuit means for limiting both voltage and current flow at the valve seat in order to avoid breakdown of a fuel insulating layer and pitting of the valve seat.

The system of the '196 patent may be effective for avoiding pitting in the particular context of a purposefully generated current flow intended to effectuate the generation of an ignition signal. However, introduction of electrical circuitry along the lines disclosed in the '196 patent in a solenoid operated valve assembly to control an unwanted electrical circuit could be ineffective from a cost standpoint. The system may also be complicated to effectively design and implement.

The disclosed apparatus and method help to overcome one or more of the shortcomings in existing technology.

SUMMARY OF THE INVENTION

One disclosed embodiment includes an apparatus for suppressing spark damage to components of a solenoid operated valve assembly. The assembly may include a solenoid having a solenoid coil and an armature movable under the influence of the solenoid coil. A valve member may be operably connected to the armature and configured to selectively contact a valve seat. An element may be associated with the solenoid operated valve assembly and configured to suppress spark discharge between two or more of the components of the valve assembly.

Another disclosed embodiment includes a method of making a spark discharge resistant solenoid operated valve assembly. The method may provide a solenoid actuated unit, including a solenoid, for selectively positioning a valve member with respect to a valve seat. The method may also provide an insulating element between the solenoid and the valve member to suppress electrical current flow between the solenoid and the valve seat.

Another disclosed embodiment may include an engine with at least one cylinder and a fuel injector configured to supply fuel to the at least one cylinder. The fuel injector may include a solenoid having a solenoid coil and a movable armature configured to move under influence of the solenoid coil. The fuel injector may also include a biasing spring associated with the solenoid and operably connected to the movable armature. A valve member may be operably connected to the movable armature and configured to selectively contact a valve seat. In addition, an insulating member may be configured to suppress spark discharge between two or more components of the fuel injector.

DETAILED DESCRIPTION

Figure 1:
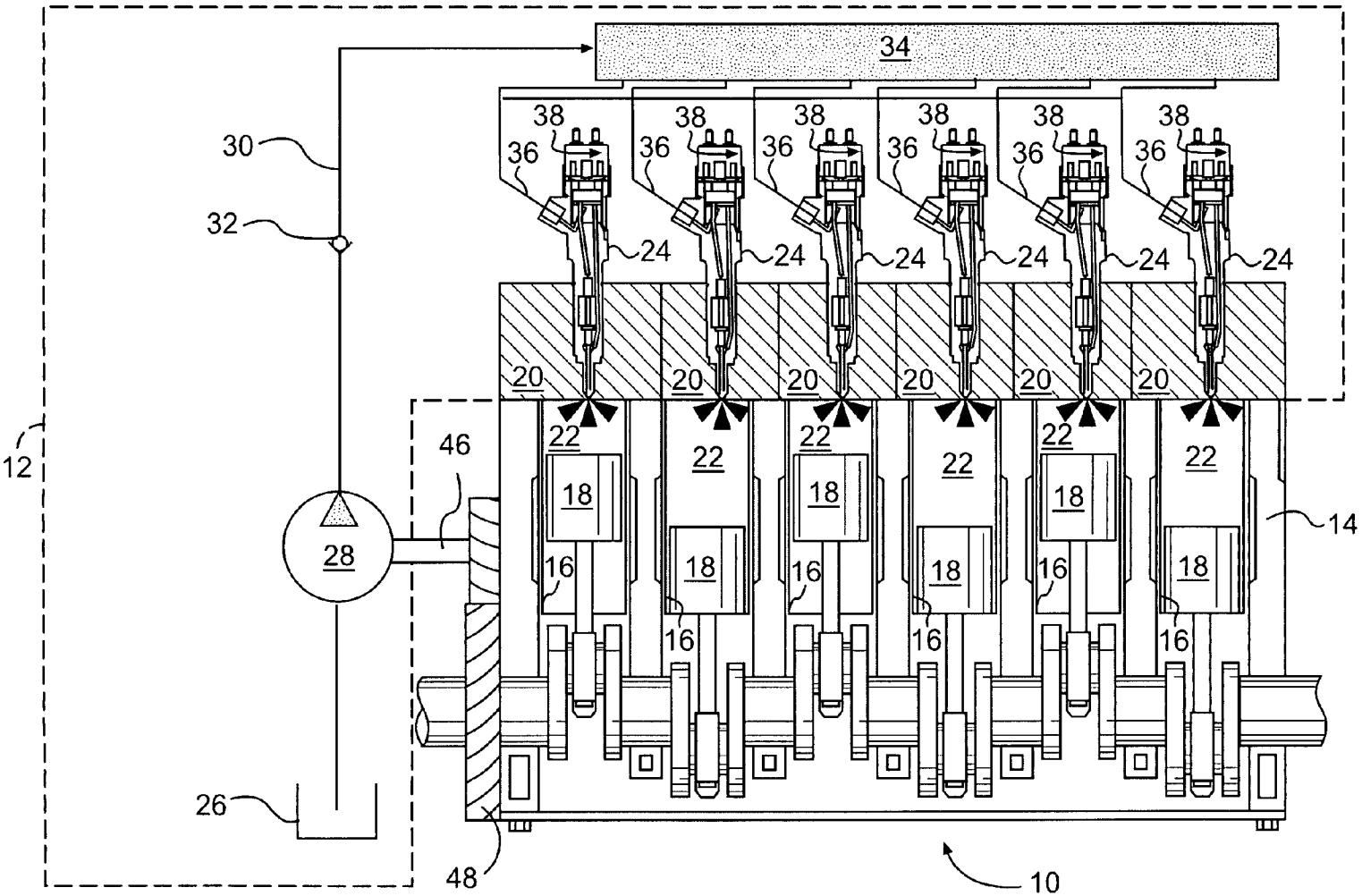
FIG. 1 is a schematic and diagrammatic illustration of an exemplary disclosed fuel injection system for an engine.

FIG. 1 diagrammatically illustrates an engine 10 with a fuel injection system 12. Engine 10 may include an engine block 14 that defines a plurality of cylinders 16, a piston 18 slidably disposed within each cylinder 16, and a cylinder head 20 associated with each cylinder 16. Cylinder 16, piston 18, and cylinder head 20 form a combustion chamber 22.

Fuel injection system 12 includes components that cooperate to deliver fuel to fuel injectors 24, which in turn deliver fuel into each combustion chamber 22. Specifically, fuel injection system 12 may include a supply tank 26, fuel pump 28, fuel line 30 with check valve 32, and manifold 34. From manifold 34, fuel is supplied to each fuel injector 24 through fuel line 36. Each fuel injector 24 may include one or more solenoid operated valve assemblies 38.

Figure 2:
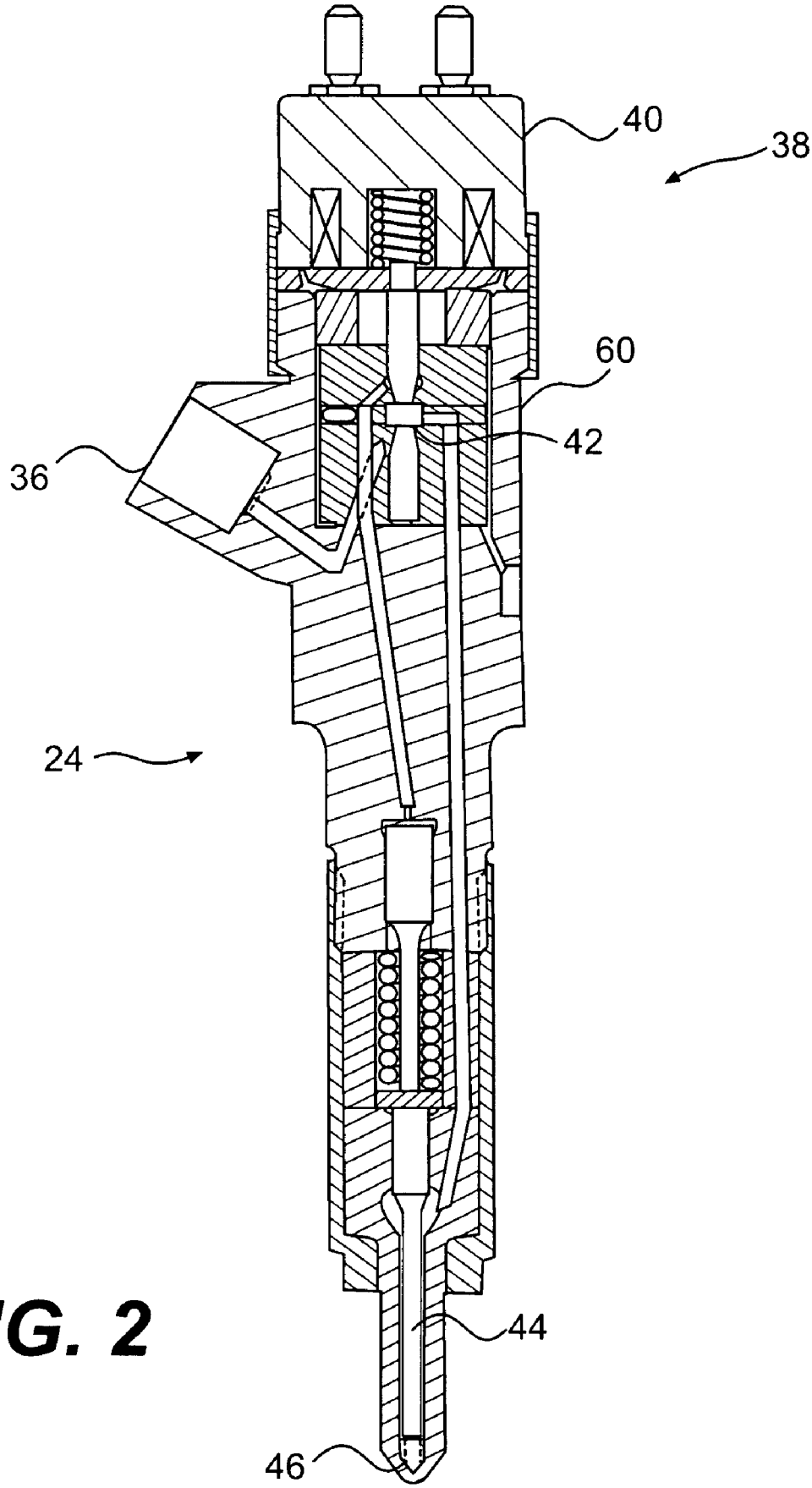
FIG. 2 is a cutaway view illustrating an exemplary disclosed fuel injector for the fuel injection system of FIG. 1.

FIG. 2 is a cutaway view of an exemplary fuel injector 24. Fuel injector 24 may include a solenoid operated valve assembly 38. Solenoid operated valve assembly 38 may include a solenoid 40. Solenoid 40 controls a valve 42 located in injector body 60, which in turn controls the flow of fuel to injector valve needle 44, which cooperates with orifice 46 to inject fuel into a combustion chamber 22 (FIG. 1).

Figure 3:
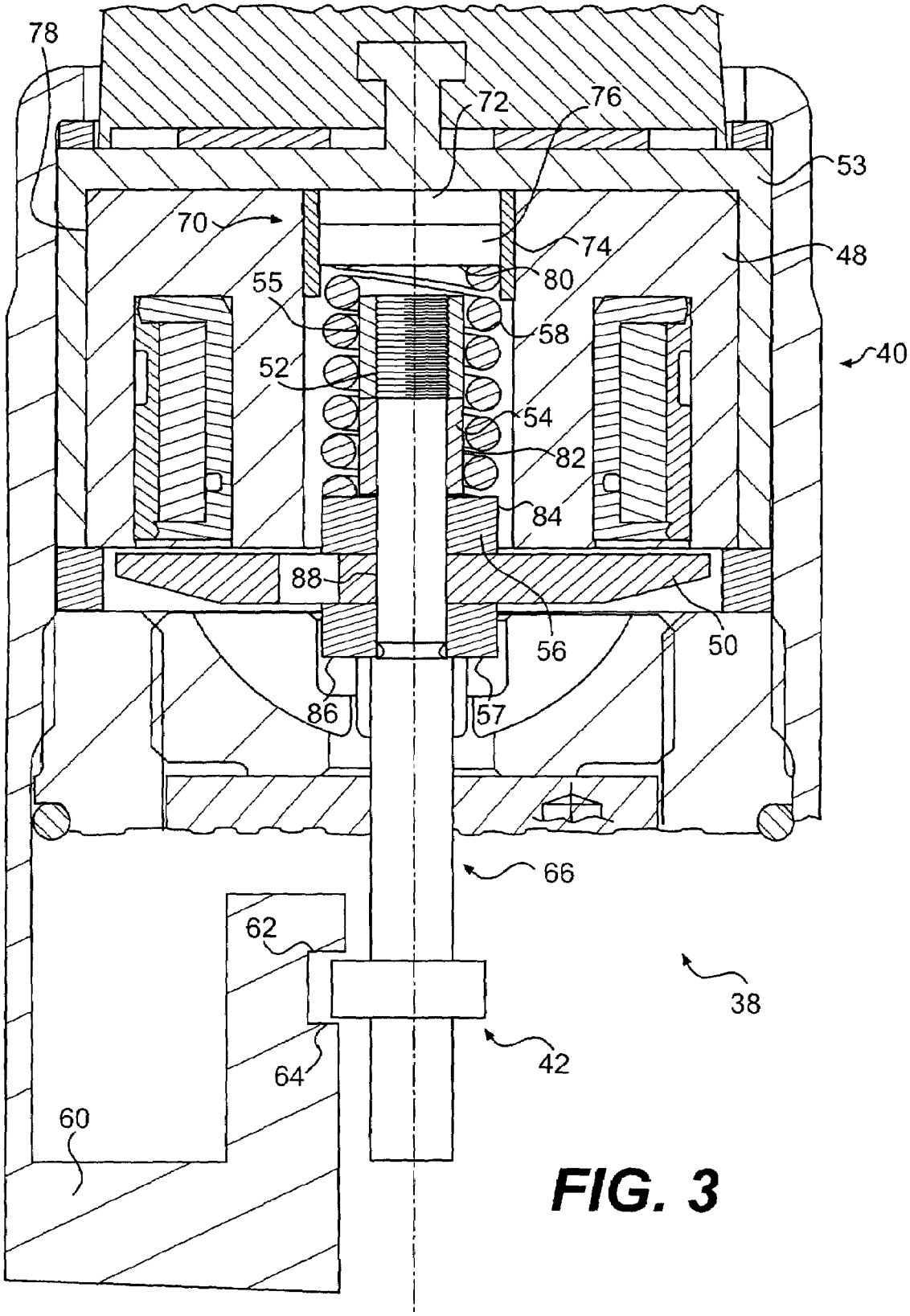
FIG. 3 is a diagrammatic and schematic illustration of a solenoid operated valve assembly.

FIG. 3 is a simplified diagrammatic and schematic illustration of relevant components of a solenoid operated valve assembly 38 that may be used, for example, in a fuel injector 24 like that shown in FIG. 2. Solenoid 40 may have a solenoid coil 48 and an armature 50. The solenoid coil 48 may be at least partially enclosed by a housing 53.

When current is supplied to solenoid coil 48, a magnetic field forms and the solenoid coil 48 becomes a magnet. Because the armature 50 is composed of a magnetically attractive material, for example a ferromagnetic material, the armature 50 is moved under the influence of solenoid coil 48. In FIG. 3, for example, the armature 50 is caused to move upwardly toward the solenoid coil 48 when current is supplied to the solenoid coil 48.

The solenoid may include a plunger 52 and armature washers 56, 57. A biasing spring 58 is operable to move armature 50 relative to solenoid housing 53. Where, as illustrated here, the armature 50 and plunger 52 are moved under the influence of the magnet in an upward direction, biasing spring 58 biases armature 50 and connected plunger 52 in the opposite, or downward (in FIG. 3), direction upon cessation of current to the solenoid coil 48.

The solenoid 40 may be connected to an injector body 60 of fuel injector 24 (FIG. 2). The fuel injector body 60 may be in contact with valve seats 62 and 64 of valve 42. The plunger 52 may be connected directly to a valve member 66. The upper end of plunger 52 may be threaded to receive nut 55 which, via plunger sleeve 54 and armature washers 56, 57, enables plunger 52 and valve member 66 to be secured to armature 50. Valve member 66 may be configured to selectively contact a valve seat 62, 64. Valve member 66 may cooperate with valve seats 62 and 64 to control valve 42 and the flow of fuel.

When current is permitted to flow to solenoid coil 48, a magnetic field is generated around solenoid coil 48. This magnetic field may, both at the time current is provided to solenoid coil 48 and at the time current flow to solenoid coil 48 ceases, induce voltage in the moving biasing spring 58. This induced voltage may allow current to flow through interconnected electrically conductive components of the solenoid operated valve assembly 38. At the same time, the armature 50 may move under the influence of the magnetic field, or under the influence of the biasing spring 58, and cause the valve member 66 either to arrive at or depart from contact with a valve seat, such as, valve seat 62 or valve seat 64. When current ceases to flow to solenoid coil 48, the magnetic field will collapse and biasing spring 58 will move armature 50 to thus move connected valve member 66 away from valve seat 62 toward valve seat 64. Similarly, when current is permitted to flow to solenoid coil 48, valve member 66 may then move away from valve seat 64 toward contact with valve seat 62. In either case, as valve member 66 arrives at or departs from a valve seat, an arc or spark discharge may occur due to the current flow which is caused by the voltage induced in biasing spring 58 by the magnetic field. This may result in pitting of valve members, such as, for example, valve seat 62 or 64.

In one embodiment, an insulating element is provided for suppressing spark discharge between two or more components of the solenoid operated valve assembly 38. FIG. 3 illustrates an embodiment wherein an insulating element interrupts the interconnection of electrically conductive components of the solenoid operated valve assembly 38 to prevent current flow to the valve member 66 and valve seats 62, 64. In one exemplary embodiment, the insulating element may be a spacer 70 disposed between the biasing spring 58 and the housing 53. Spacer 70 may be variously formulated. For example, spacer 70 may be a single piece or it may comprise plural pieces. In an exemplary embodiment, spacer 70 may include a disc 72 and a sleeve 74. The disc 72 and sleeve 74 may be separate elements. Alternatively, disc 72 and sleeve 74 may be integrally formed. In one embodiment, disc 72 may be present while sleeve 74 may be absent. In another embodiment, sleeve 74 may be present while disc 72 may be absent. Disc 72 and sleeve 74 may be of various sizes. For example, disc 72 may extend further along the upper surface of housing 53 than shown in FIG. 3, and sleeve 74 may extend further along the length of biasing spring 58 than shown in FIG. 3. Electrically conductive shim 76 may be present between the spacer 70 and the biasing spring 58. Alternatively, electrically conductive shim 76 may be absent.

The insulating element may be made of any suitable material capable of substantially interrupting current flow between electrically conductive elements of the solenoid operated valve assembly 38. For example, the insulating element may be made of a suitable polymer such as, for example, polyphenylene sulfide (PPS). The insulating element may also be made of any suitable ceramic, such as, for example, aluminum zirconium.

In another embodiment, the insulating element may be a coating of electrically insulating material on electrically conductive components of the solenoid operated valve assembly 38. The coating may be any type of electrically insulating material such as, for example, a ceramic material. Any one of, or any combination of, the electrically conductive components of the solenoid operated valve assembly 38 may be provided with a coating of electrically insulating material. For example, a coating 78 may be provided for an inner surface of the housing 53, a coating 80 may be provided for shim 76, a coating 82 may be provided for plunger sleeve 54, a coating 84 may be provide for upper armature washer 56, a coating 86 may be provided for lower armature washer 57, and/or a coating 88 may be provided for the plunger 52 and the upper part of connected valve member 66.

In one embodiment, sleeve 74 may be a shrink tube of suitable polymer material provided, for example, to surround the outer diameter of the disc 72, shim 76, and at least a portion of the biasing spring 58. Alternatively, sleeve 74 may be a plastic sleeve at least partially separating metallic components from the solenoid coil 48.

Instead of, or in addition to, the insulating element, an element in the form of a magnetic flux reduction spacer may be provided to reduce magnetic flux fringing into the biasing spring 58. This feature may be accomplished, for example, by forming the upper armature washer 56 of stainless steel.

Figure 4:
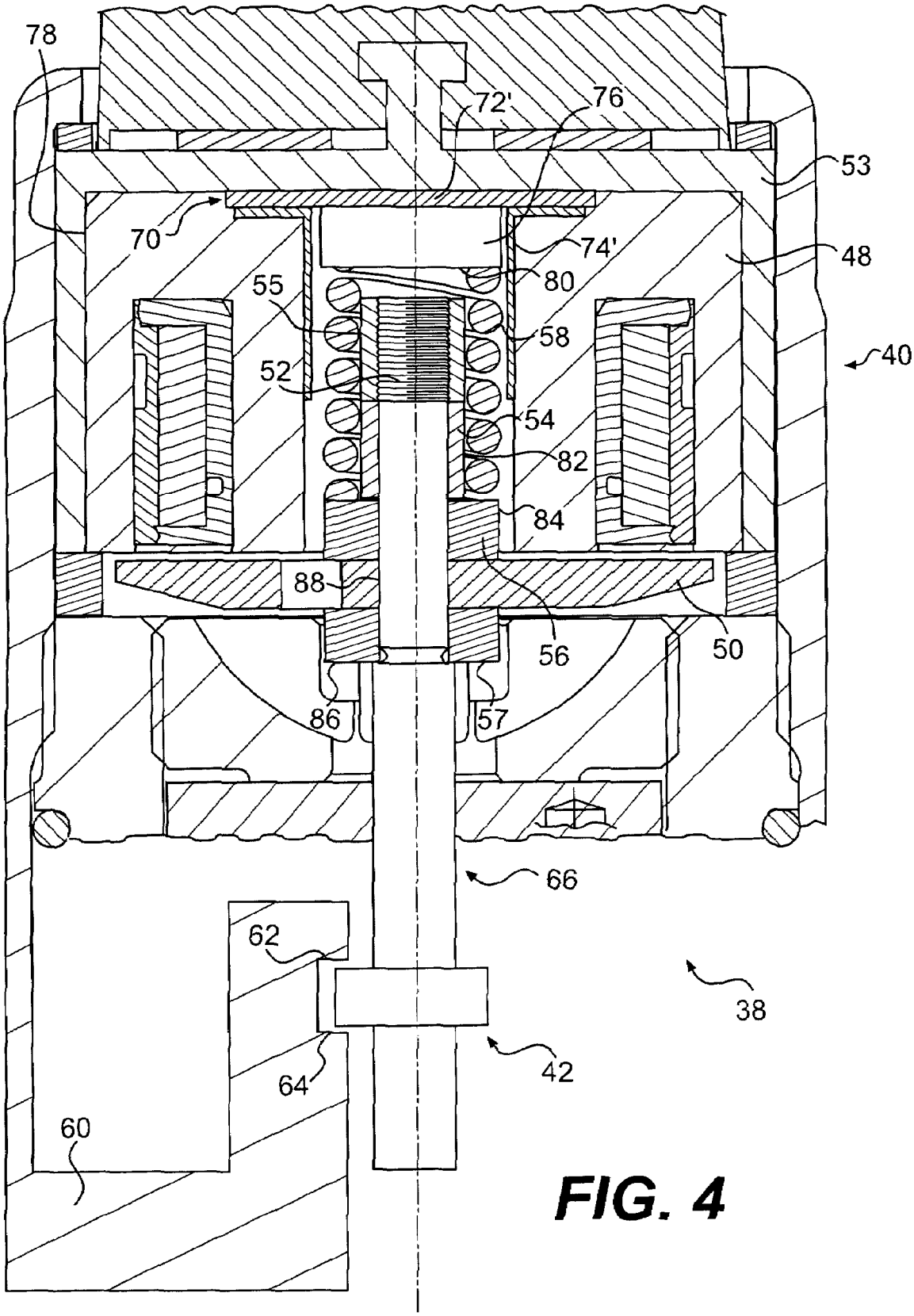
FIG. 4 is a diagrammatic and schematic illustration of another embodiment of a solenoid operated valve assembly.

FIG. 4 is a simplified diagrammatic and schematic illustration of yet another embodiment of relevant components of a solenoid operated valve assembly 38 that may be used, for example, in a fuel injector 24 like that shown in FIG. 2. Elements in FIG. 4 corresponding to elements in FIG. 3 bear the same reference numeral. In FIG. 4, the spacer 70 may be in the form of a disc 72' made, for example, of polymer. Disc 72' may be made of a polymer sold under the trademark MYLAR™. As illustrated in FIG. 4, disc 72' may lie between housing 53 and the existing metallic shim 76 and existing metallic sleeve 74'. Of course, disc 72' could be made of any suitable electrically insulating material such as, for example, a ceramic material.

Other means to avoid spark damage may include reducing the number of coils in biasing spring 58 or shorting the coils to each other to minimize or eliminate induced current. Spark damage may be adequately suppressed by using a Belleville spring stack for the biasing spring. Another way to avoid spark damage may be to increase resistance to any induced current by providing resistors in the current path. Another way to avoid spark damage may be to provide a short circuit to direct current around the valve members instead of through them. Yet another way to avoid spark damage may be to lower current to the solenoid coil 48 and thereby reduce unwanted induced current flowing to the valve members.

INDUSTRIAL APPLICABILITY

The disclosed embodiments may find applicability in any type of solenoid operated valve assembly where unwanted induced current may cause spark discharge in associated valve members. In one exemplary disclosed embodiment, the solenoid operated valve assembly may be a part of a fuel injection system 12.

FIGS. 3 and 4 show exemplary manners in which the invention may be implemented in the context of a solenoid operated valve assembly of a fuel injector. Practical realities typically dictate that metallic or otherwise conductive components of a solenoid operated valve assembly 38 of a fuel injector 24 may be intimately connected to one another in the interest of space conservation and efficient packaging. In a solenoid operated valve assembly 38, it happens that actuation of solenoid 40 in a fuel injector 24 typically requires very rapid firing of the solenoid coil 48. For example, in a 2200 rpm, 4 shot system, there may be 73 shots/sec. This is equivalent to 264,000 shots/hr. Assuming that arcing is widely intermittent and only occurs just 1% of the time, this still equals 2,640 arcs/hr. The area of face-to-face contact between surfaces in a valve 42 of a fuel injector 24 typically may be only 0.72 $mm_2$. Thus it can be seen that a typical valve seat 62, 64 may be subjected to substantial arcing or spark discharge and resulting pitting and wear.

The insulating element has been illustrated in the form of a spacer 70 including disc 72 (or 72') and/or sleeve 74 and/or coating 78, 80, 82, 84, 86, 88. It is to be understood, however, that limitation is not thereby placed on the particular shape for the insulating element or on the particular location for the insulating element other than that it be so placed as to effectively interrupt the circuit that leads to arcing between valve elements. For example, sufficient electrically insulating structure could be placed at any point in the circuit formed through biasing spring 58, housing 53, injector body 60, valve seats 62, 64, valve member 66, plunger 52, armature 50, armature washers 56, 57, plunger sleeve 54, nut 55, metallic sleeve 74' (FIG. 4), shim 76, or any other component present in a solenoid operated valve assembly capable of permitting current flow to a valve element.

The insulating element, or other insulating structure, may be formed of any of numerous insulating structures that otherwise possess characteristics suitable for use in the intended environment. For example, numerous polymers, ceramics, and composite materials used as electrical insulating materials may be used. The insulating element, or other insulating structure, can be secured in place in any of numerous ways, such as, for example, mechanical attachment by fasteners, adhesive bonding, or molding in place.

While disclosed herein as applicable to fuel injection solenoid valves, it is apparent that disclosed embodiments have applicability in other types of solenoid valves. The disclosed embodiments are contemplated to apply to any field of endeavor using solenoid valves, particular where the arrangement is such that arcing tends to occur between the valve components. For example, the disclosed embodiments may also be used in the area of pump control valves.

The method disclosed contemplates the provision of the various generic components of a solenoid operated valve assembly coupled with the interruption of the electrically conductive circuit otherwise formed by the various components of the solenoid operated valve assembly so as to prevent arcing between a valve member and a valve seat. This interruption of the electrically conductive circuit may be accomplished by placing an electrically insulating element anywhere in the circuit to prevent current flow and resulting arcing between valve components.

The orientation of the solenoid and the valve are not critical to the implementation of the disclosed system. The orientation could obviously be different from that shown in the drawings. Moreover, the valve could be of the type that cooperates with a single seat or of the type that cooperates with plural seats since arcing and pitting obviously can occur in either type of valve.

Although embodiments of the invention have been described, it will be apparent to those skilled in the art that various modifications and variations can be made in the disclosed apparatus and method for avoiding spark damage in valve members without departing from the scope of the disclosure. In addition, other embodiments of the disclosed apparatus and method will be apparent to those skilled in the art from consideration of the specification. It is intended that the specification and examples be considered as exemplary only, with a true scope of the disclosure being indicated by the following claims and their equivalents.

What is claimed is:

1. An apparatus for suppressing spark damage to components of a solenoid operated valve assembly, comprising:

a solenoid having a solenoid coil;

an armature movable under influence of the solenoid coil;

a biasing spring in operable communication with the armature;

a valve member operably connected to the armature and configured to selectively contact a valve seat; and an element associated with the solenoid operated valve assembly and configured to suppress spark discharge between two or more of the components of the solenoid operated valve assembly;

wherein the biasing spring includes a coil spring wound about a central, longitudinal axis, the biasing spring also including a first end and a second end longitudinally spaced from the first end along the central, longitudinal axis; and wherein the element includes a spacer positioned along the central, longitudinal axis, between the first end of the biasing spring and the housing.

2. The apparatus of claim 1, wherein the element is a magnetic flux reduction spacer.

3. The apparatus of claim 2, wherein the magnetic flux reduction spacer is made of stainless steel.

4. An apparatus for suppressing spark damage to components of a solenoid operated valve assembly, comprising:

a solenoid having a solenoid coil;

an armature movable under influence of the solenoid coil;

a biasing spring in operable communication with the armature;

wherein the biasing spring includes a coil spring wound about a central, longitudinal axis, the biasing spring also including a first end and a second end longitudinally spaced from the first end along the central, longitudinal axis;

a valve member operably connected to the armature and configured to selectively contact a valve seat; and an insulating element configured to suppress spark discharge between two or more of the components of the valve assembly;

wherein the solenoid includes a housing and a metallic shim disposed along the central, longitudinal axis, between the first end of the biasing spring and the housing; and wherein the insulating element includes a spacer positioned at least partially between the metallic shim and the housing.

5. The apparatus of claim 4, wherein the insulating element includes a polymer and is configured to suppress spark discharge between the valve member and the valve seat.

6. The apparatus of claim 5, wherein the polymer includes polyphenylene sulfide.

7. The apparatus of claim 4, wherein the insulating element includes a ceramic.

8. The apparatus of claim 7, wherein the ceramic includes aluminum zirconium.

9. The apparatus of claim 4, further including a sleeve extending at least partially between the solenoid coil and the biasing spring.

10. The apparatus of claim 4, further including an insulative coating disposed on an inner surface of the housing.

11. The apparatus of claim 4, further including a plastic sleeve disposed at least partially between the biasing spring and the solenoid coil.

12. The apparatus of claim 4, wherein the solenoid operated valve assembly includes an armature washer between the spring and the armature, and a coating of insulating material on at least one of the housing, the metallic shim, and the armature washer.

13. A method of making a spark discharge resistant solenoid operated valve assembly, comprising:

providing a solenoid actuated valve, including a solenoid, for selectively positioning a valve member with respect to a valve seat;

providing an armature, a biasing spring, a housing, and at least one of a metallic shim between the spring and the housing, and an armature washer between the spring and the armature;

providing an insulating element between the solenoid and the valve to suppress electrical current flow between the solenoid and the valve seat; and wherein providing the insulating element includes coating at least one of the metallic shim and the armature washer with an insulating material.

14. The method of claim 13, wherein the insulating element includes a ceramic material.

15. The method of claim 13, further including:

providing an insulating element between the biasing spring and the housing.

16. The method of claim 13, wherein the method further includes inserting an insulating spacer between the biasing spring and the housing.

17. The method of claim 13, wherein the solenoid operated valve assembly includes a metallic spacer between the biasing spring and the housing, and wherein the method further includes inserting an insulating spacer between the metallic spacer and the housing.

18. An engine comprising:

at least one cylinder; and a fuel injector, including a solenoid operated valve assembly, configured to supply fuel to the at least one cylinder, wherein the solenoid operated valve assembly includes:

a solenoid comprising a solenoid coil and a movable armature configured to move under influence of the solenoid coil;

a biasing spring associated with the solenoid and operably connected to the movable armature;

wherein the biasing spring includes a coil spring wound about a central, longitudinal axis, the biasing spring also including a first end and a second end longitudinally spaced from the first end along the central, longitudinal axis;

a valve member operably connected to the movable armature and configured to selectively contact a valve seat; and an insulating element configured to suppress spark discharge between two or more components of the fuel injector;

wherein the solenoid operated valve assembly includes a housing and a metallic shim disposed along the central, longitudinal axis, between the first end of the biasing spring and the housing; and wherein the insulating element includes a spacer positioned at least partially between the metallic shim and the housing.

19. The engine of claim 18, wherein the insulating element includes at least one of a polymer and a ceramic material.

20. The engine of claim 18, wherein the valve assembly further includes a sleeve extending at least partially between the solenoid coil and the biasing spring.

21. The engine of claim 18, further including an insulative coating disposed on a component of the solenoid operated valve assembly.

22. The engine of claim 18, wherein the solenoid operated valve assembly further includes:

a plunger, a bearing for the plunger, and at least one armature washer; and an insulative coating disposed on at least one of the housing, the metallic shim, the plunger, the bearing, and the at least one armature washer.

23. An apparatus for suppressing spark damage to components of a solenoid operated valve assembly, comprising:

a solenoid having a solenoid coil;

an armature movable under influence of the solenoid coil;

a valve member operably connected to the armature and configured to selectively contact a valve seat; and an insulating element for suppressing spark discharge between two or more of the components of the valve assembly;

wherein the insulating element includes a ceramic.

24. The apparatus of claim 23, further including an element configured to reduce magnetic flux from the solenoid.

* * * * *